US010112160B2

(12) United States Patent
Witte et al.

(10) Patent No.: US 10,112,160 B2
(45) Date of Patent: Oct. 30, 2018

(54) CHEMICAL MIXING AND PUMPING UNIT AND METHODS FOR OILFIELD OPERATIONS

(71) Applicant: PREMIER COIL SOLUTIONS, INC., Waller, TX (US)

(72) Inventors: M. Brett Witte, Waller, TX (US); Randall Dean Behrens, Sealy, TX (US); Shawn Shivers, Brenham, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 319 days.

(21) Appl. No.: 15/000,181

(22) Filed: Jan. 19, 2016

(65) Prior Publication Data

US 2017/0203268 A1 Jul. 20, 2017

(51) Int. Cl.

| | |
|---|---|
| ***B01F 7/20*** | (2006.01) |
| ***E21B 37/00*** | (2006.01) |
| ***B01F 5/02*** | (2006.01) |
| ***B01F 7/00*** | (2006.01) |
| ***B01F 3/12*** | (2006.01) |

(52) U.S. Cl.

CPC ..... *B01F 7/20* (2013.01); *B01F 3/1221* (2013.01); *B01F 5/0206* (2013.01); *B01F 7/00975* (2013.01); *E21B 37/00* (2013.01)

(58) Field of Classification Search

USPC ..... 366/279

See application file for complete search history.

(56) References Cited

U.S. PATENT DOCUMENTS

| | | | | |
|---|---|---|---|---|
| 3,857,985 | A * | 12/1974 | Reid | A23D 9/02 426/417 |
| 5,053,082 | A | 10/1991 | Flanigan et al. | |
| 5,147,133 | A | 9/1992 | White | |
| 5,246,287 | A * | 9/1993 | Isherwood | B01F 3/1271 366/111 |
| 5,447,388 | A * | 9/1995 | Rouse | B01F 3/1221 404/101 |
| 5,571,281 | A * | 11/1996 | Allen | B01F 3/12 366/163.1 |
| 6,350,054 | B1 | 2/2002 | Lee et al. | |
| 2005/0002270 | A1* | 1/2005 | Bergman | B01F 5/0057 366/165.2 |
| 2005/0092671 | A1 | 5/2005 | Mueller | |

FOREIGN PATENT DOCUMENTS

| | | |
|---|---|---|
| CA | 2867496 A1 | 8/2014 |

OTHER PUBLICATIONS

Int'l Search Report & Written Opinion (PCT/US2017/013855), dated Apr. 13, 2017.

* cited by examiner

*Primary Examiner* — Mark Halpern

(74) *Attorney, Agent, or Firm* — Lloyd L. Davis; Hunton Andrews Kurth LLP

(57) ABSTRACT

A mixing tank disposed onboard a unit for coiled tubing oilfield operations includes a mixing paddle within the mixing tank capable of agitating liquids therein, a water inlet capable of introducing water into the mixing tank and directing water flow toward the mixing paddle, and one or more chemical inlets capable of introducing one or more chemicals from chemical storage units into the mixing tank.

12 Claims, 6 Drawing Sheets

CHEMICAL MIXING AND PUMPING UNIT AND METHODS FOR OILFIELD OPERATIONS

FIELD

Embodiments disclosed herein relate to chemical mixing and pumping units and related methods for oilfield operations.

BACKGROUND AND SUMMARY

Coiled tubing operations in oil and gas wells generally involve delivering by large pumping units pressurized fluid mixtures downhole through a coiled tubing string. Chemical additives and lubricants are commonly added to fluid mixtures as an integral step for performing efficient coiled tubing operations. Chemical additives and lubricants have generally been hand mixed by personnel on the side in small batches and poured through an open top of a mixing tank associated with the pumping unit, or mixed in another unit and delivered to the pumping unit. However, these mixtures are generally inadequately mixed and unstable due to air in the mixture. Moreover, water is poured into the mixture through an open top of a mixing tank causing the water to splash and bubble inside the tank. The air pockets created result in an improper mixture and are detrimental to coiled tubing operations when forced downhole. Previous mixing tanks have also generally been inadequate for running specialized fluid mixtures downhole, such as gel sweeps. What is needed then is an improved chemical mixing and pumping unit for oilfield operations.

In one aspect, embodiments disclosed herein relate to a chemical mixing and pumping unit for oilfield operations including at least one mixing tank onboard the chemical mixing and pumping unit. The mixing tank includes one or more mixing paddles within the mixing tank capable of agitating liquids therein, one or more water inlets capable of introducing water into the mixing tank and directing water flow toward the one or more mixing paddles, and one or more chemical inlets capable of introducing one or more chemicals into the mixing tank. The chemical mixing and pumping unit further includes one or more storage tanks capable of storing chemicals onboard the chemical mixing and pumping unit, and one or more pumps corresponding to the individual storage tanks capable of delivering chemicals from the storage tanks to the one or more chemical inlets in the at least one mixing tank.

In another aspect, embodiments disclosed herein relate to a mixing tank disposed onboard a unit for coiled tubing oilfield operations, the mixing tank including a mixing paddle within the mixing tank capable of agitating liquids therein, a water inlet capable of introducing water into the mixing tank and directing water flow toward the mixing paddle, and one or more chemical inlets capable of introducing one or more chemicals from chemical storage units into the mixing tank.

In yet another aspect, embodiments disclosed herein relate to a method of mixing liquids in a mixing tank prior to pumping a liquid mixture downhole. The method includes inputting one or more chemicals into the mixing tank through one or more corresponding chemical inlets, inputting water into the mixing tank through a water inlet at the bottom of the mixing tank and directing the water towards a mixing paddle within the mixing tank, and rotating the mixing paddle in a direction opposite that of the water stream directed towards the mixing paddle, thereby agitating and mixing liquids within the mixing tank.

BRIEF DESCRIPTION OF THE DRAWINGS

The invention is illustrated in the accompanying drawings wherein.

DETAILED DESCRIPTION

Figure 1:
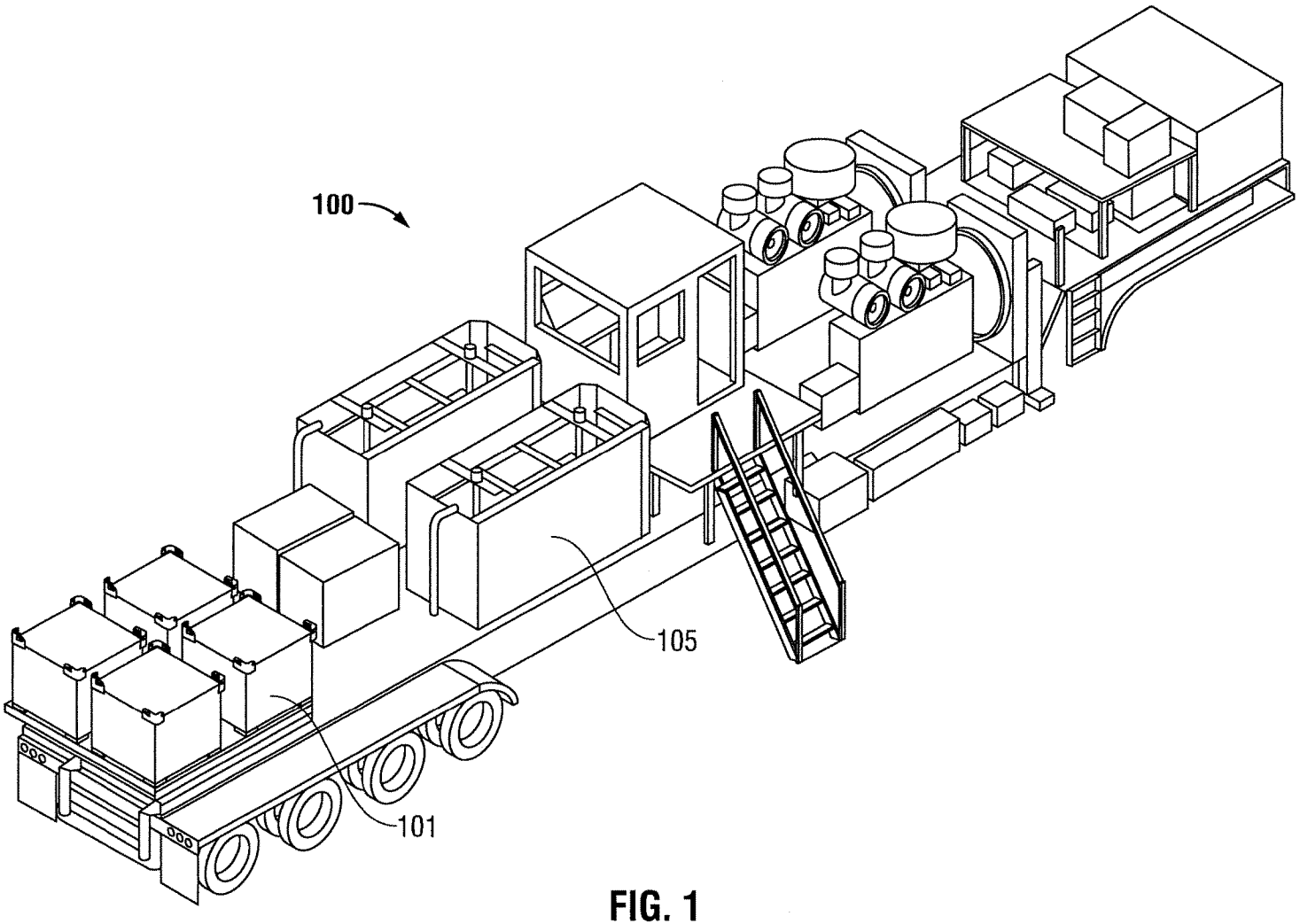
FIG. 1 illustrates a perspective view of an embodiment of a chemical mixing and pumping unit for oilfield operations.

Embodiments disclosed herein relate to chemical mixing and pumping units and methods for oilfield operations. Other embodiments disclosed herein relate to chemical mixing and pumping units and methods for coiled tubing oilfield operations. Yet other embodiments disclosed herein relate to mixing tanks used on chemical mixing and pumping units, and related methods of operating the mixing tanks.

A chemical mixing and pumping unit may provide for onboard storage of one or more chemicals either permanently mounted on the pumping unit, or affixed using a cradle, skid-based, or mounting hardware either permanently affixed or temporary. The chemical storage may be contained in a permanently mounted tank or tanks of variable capacity, or temporarily attached tanks of variable capacity. The chemical storage may also be divided internally to allow for further chemicals to be stored in any capacity. These tanks may be constructed of any number of materials including plastic, metal, or a combination thereof that can prevent spillage from the unit. Cradling may be achieved by permanent placeholders or hardware.

Chemical mixing pumps may be disposed onboard the chemical mixing and pumping unit. The chemical mixing pumps may be any commercially available mixing pumps. The mixing pumps may be capable of providing flow from the aforementioned storage tanks at gallon per minute ("GPM") rates suitable for introducing chemicals into the pumps or mixing tanks, also known as displacement tanks. These pumps may be independently controlled or controlled via a computer system or program that may calculate the adjustment of one or more chemicals from the chemical storage throughout mixing and pumping operations. The pumps may have any form of attachment to piping or the chemical storage tanks such as threaded, welded, brazed, or any other connection style such as a flanged connection.

One or more mixing or displacement tanks may be disposed onboard the chemical mixing and pumping unit. The displacement tanks may be any commercially available displacement tanks. The chemical mixing and pumping unit may have sufficient capacity for chemical mixing operations that exceeds twenty (20) barrels without refilling the aforementioned mixing tanks. In other embodiments, the chemical mixing and pumping unit may have sufficient capacity for chemical mixing operations that exceed thirty (30)

barrels without refilling the mixing tanks. In certain embodiments, the mixing tanks have an integrated overflow tube or channel in case of overfill. The overflow tube or channel may extend fully or partially around the perimeter of the mixing tank. Certain embodiments disclosed herein may be automated to calculate proper types and amounts of chemicals needed for a particular job. Automated embodiments may continuously update the mixture as needed in the event of changes in operational pressure per square inch ("psi"), revolutions per minute ("rpm"), and gpm without need to stop for recalculation.

Each mixing tank includes mixing paddles within, which when rotated or oscillated or otherwise moved, agitate fluids within the mixing tank. The mixing paddles may be operated or powered by motors, such as hydraulic, electric, pneumatic or otherwise. The mixing paddles may be rotated or operated at different speeds. The mixing paddles generally may include at least one flat, bladed oar-type structure attached to a shaft that when rotated or moved causes the structure to contact fluid within the mixing tank and move the fluid about so as to create a shearing action in the fluid. In certain embodiments, there may be only a single oar-type structure attached to a shaft. In other embodiments, there may be two or more (e.g., three, four, six, etc.) oar-type structures attached to a shaft. The two or more oar-type structures may be equally or unequally arranged or spaced about the shaft. In one embodiment, the oar-type structures may be substantially perpendicular relative to a horizontal plane (i.e., vertical). In other embodiments, the oar-type structures may be angled relative to a horizontal plane. For example, the oar-type structures may be angled about 45 degrees relative to horizontal. In another example, the oar-type structures may be angled between about 30 degrees and 60 degrees relative to horizontal. In yet another example, the oar-type structures may be angled between about 10 degrees and 80 degrees relative to horizontal. Mixing paddles having multiple oar-type structures may have individual oar-type structures angled at different orientations from others on the same mixing paddle. Mixing tanks having multiple mixing paddles may have mixing paddles with oar-type structures angled at different orientations from other mixing paddles in the mixing tank.

Each mixing tank includes chemical inlets for delivering chemicals from a separate chemical storage container to the mixing tank. In one embodiment, the chemical inlets may be located on a top or upper portion or surface of the mixing tank. Alternatively, the chemical inlets may be located on other parts of the mixing tank. In certain embodiments, chemicals are pumped from the chemical storage tanks (by mixing pumps) and delivered through individual corresponding lines to chemical inlets. In other embodiments, chemicals may be routed through a manifold to isolate or introduce chemicals to multiple mixing tanks with either automated or manual controls. Chemicals are introduced into the mixing tank through the chemical inlets at the top of the tanks and drop directly into the mixing tanks during agitation by the mixing paddles, which results in minimal splashing and oxygenation of the mixture.

Each mixing tank includes one or more water inlets in a lower portion of the mixing tank, or in certain embodiments, at the bottom of the mixing tank. Water inlets introduce water into the mixing tanks. Water inlets located at or near the bottom of the mixing tank may reduce general bubbling or foaming of fluids usually common with top filled units. The water inlets may have a nozzle or decreasing diameter near an exit orifice to increase velocity of the exiting fluid stream, which may produce a jet type flow to improve mixing and create shear. The water inlets direct the water flow towards a nearby mixing paddle, and more specifically, towards the oar-type structures of the mixing paddle. That is, the water inlets direct the water flow to impinge directly on the oar-type structures of the mixing paddle. For instance, a distal end of the water inlet may be disposed from between one (1) and twenty (20) inches from the oar-type structure(s) of the nearest mixing paddle as the oar-type structure(s) pass by the water inlet. In one embodiment, the mixing paddles rotate in a direction opposite the direction of water flow entering the mixing tank from the water inlet. That is, the mixing oar-type structures of the mixing paddle move toward or approach the stream of water entering the mixing tank. This configuration causes the water stream to strike or impinge on the oar-type structures of the mixing paddle and create a vortex or vortices in the mixture. As a result, agitation of the liquids is greatly increased providing improved mixing and incorporating of liquids within the mixing tank.

Figure 2:
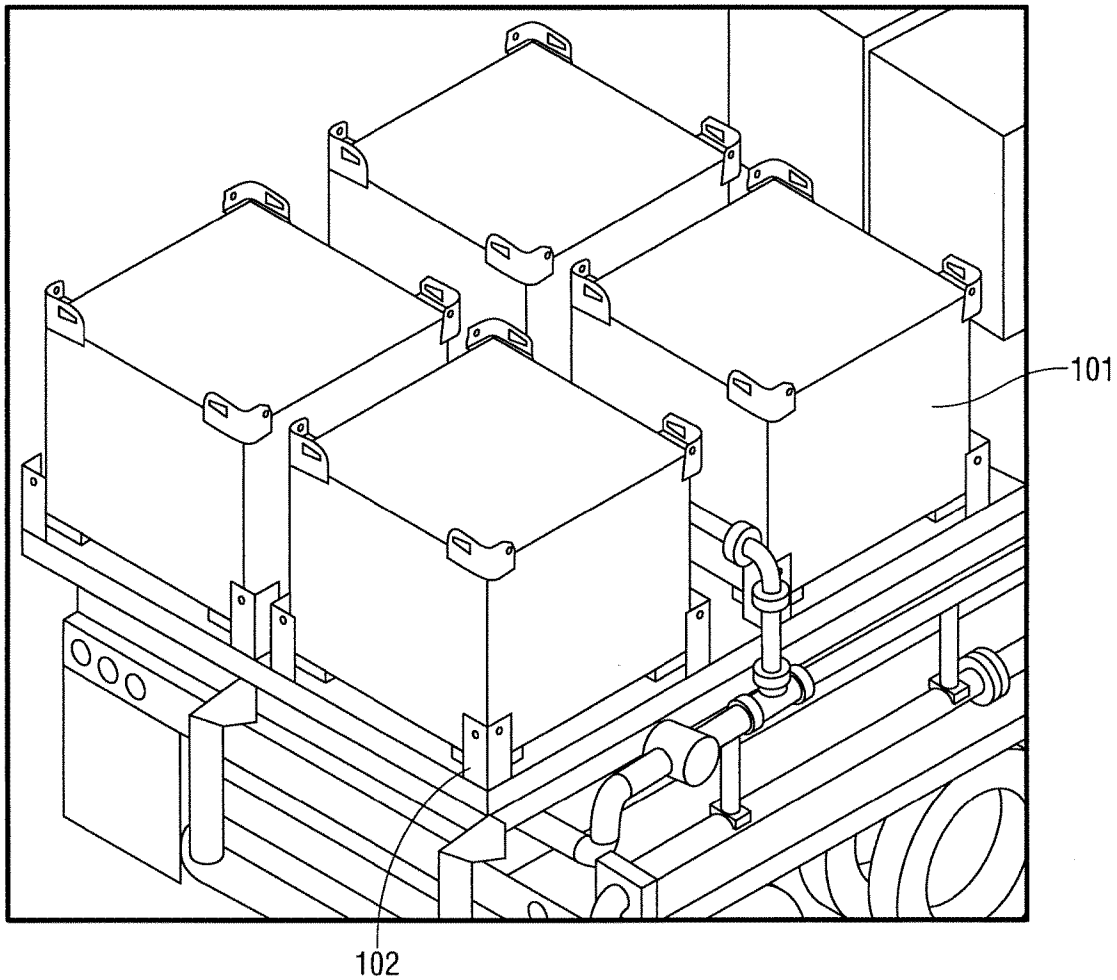
FIG. 2 illustrates a perspective view of an embodiment of chemical storage tanks onboard a chemical mixing and pumping unit.

FIG. 1 illustrates one embodiment of a chemical mixing and pumping unit 100. The unit 100 includes onboard chemical storage tanks 101 (also shown in FIG. 2) and mixing (or displacement) tanks 105. Chemical storage tanks 101 may provide for onboard storage of one or more chemicals either permanently mounted on the pumping unit 100, or affixed using cradle mounting hardware 102 either temporarily or permanently affix the storage tank on the pumping unit. The chemical storage tanks 101 may include internal dividers to allow for multiple chemicals to be stored therein in any capacity.

Figure 3:
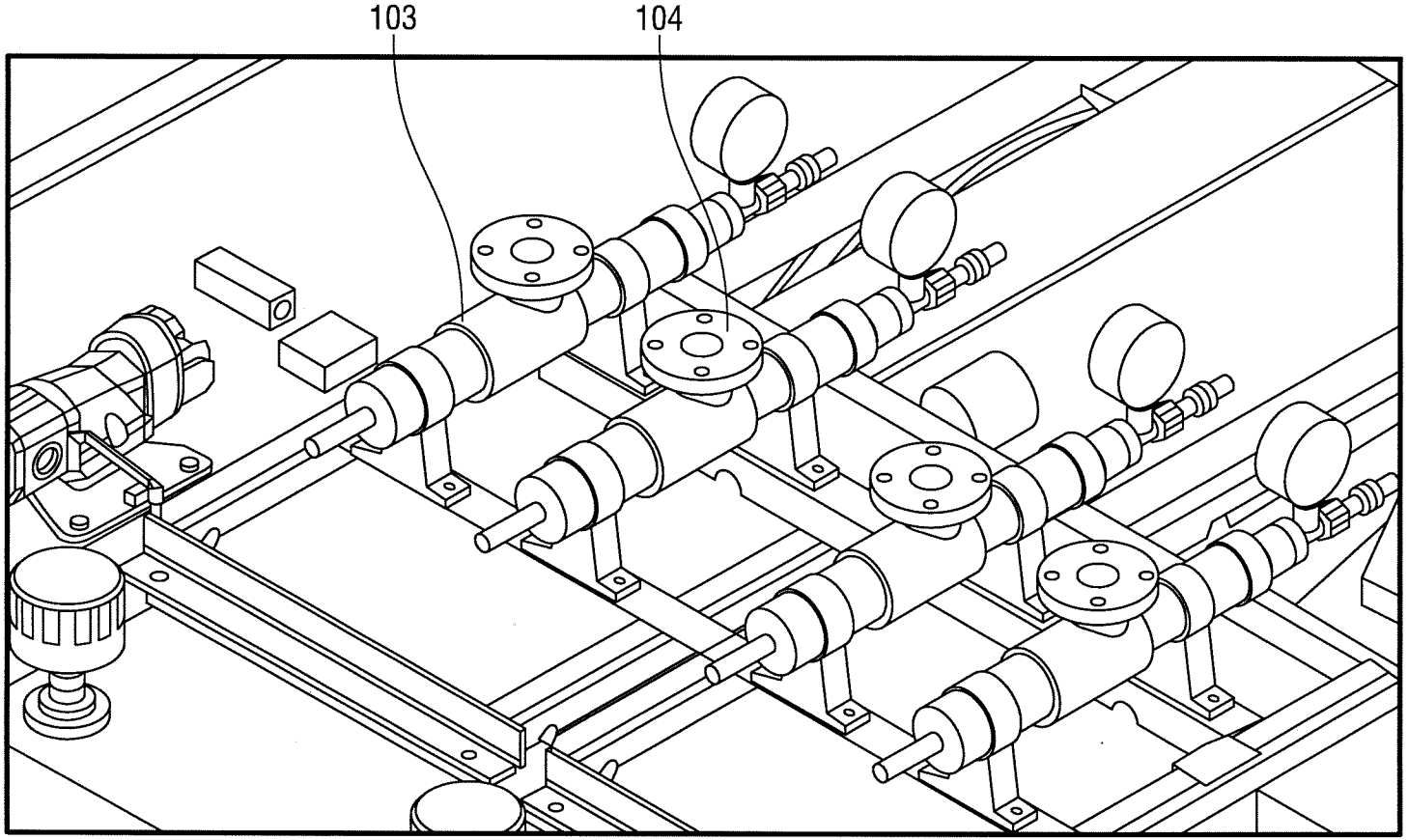
FIG. 3 illustrates a perspective view of an embodiment of mixing pumps onboard a chemical mixing and pumping unit.

FIG. 3 illustrates one embodiment of chemical mixing pumps 103 which may be disposed underneath the chemical storage tanks onboard the chemical mixing and pumping unit 100. The pumps may have any form of attachment to piping such as threaded, welded, brazed, or any other connection style such as a flanged connection 104. Each pump may include a flow rate meter to monitor flow rate of fluids being pumped.

Figure 4:
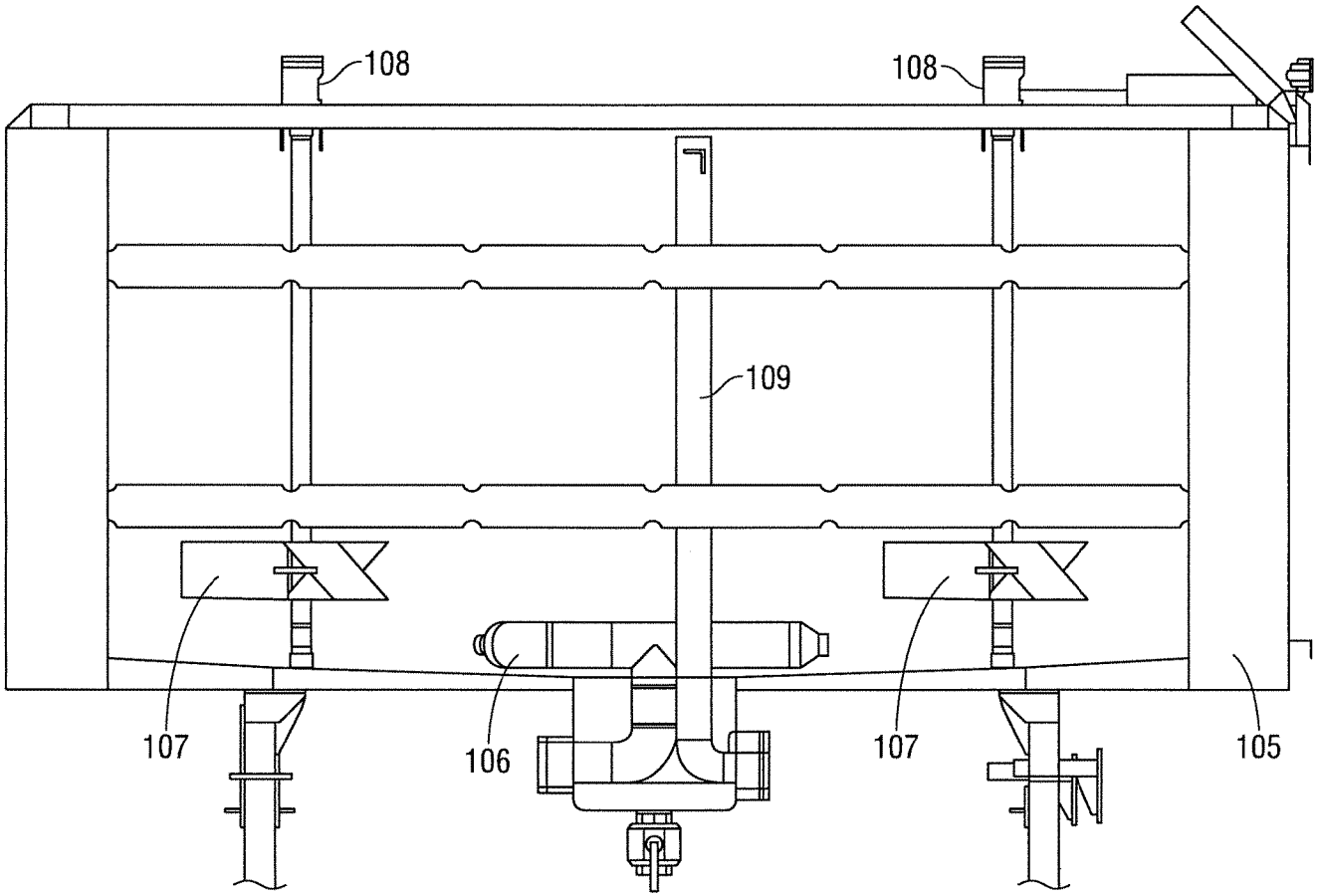
FIG. 4 illustrates a cross-section view of an embodiment of a mixing tank.
Figure 5:
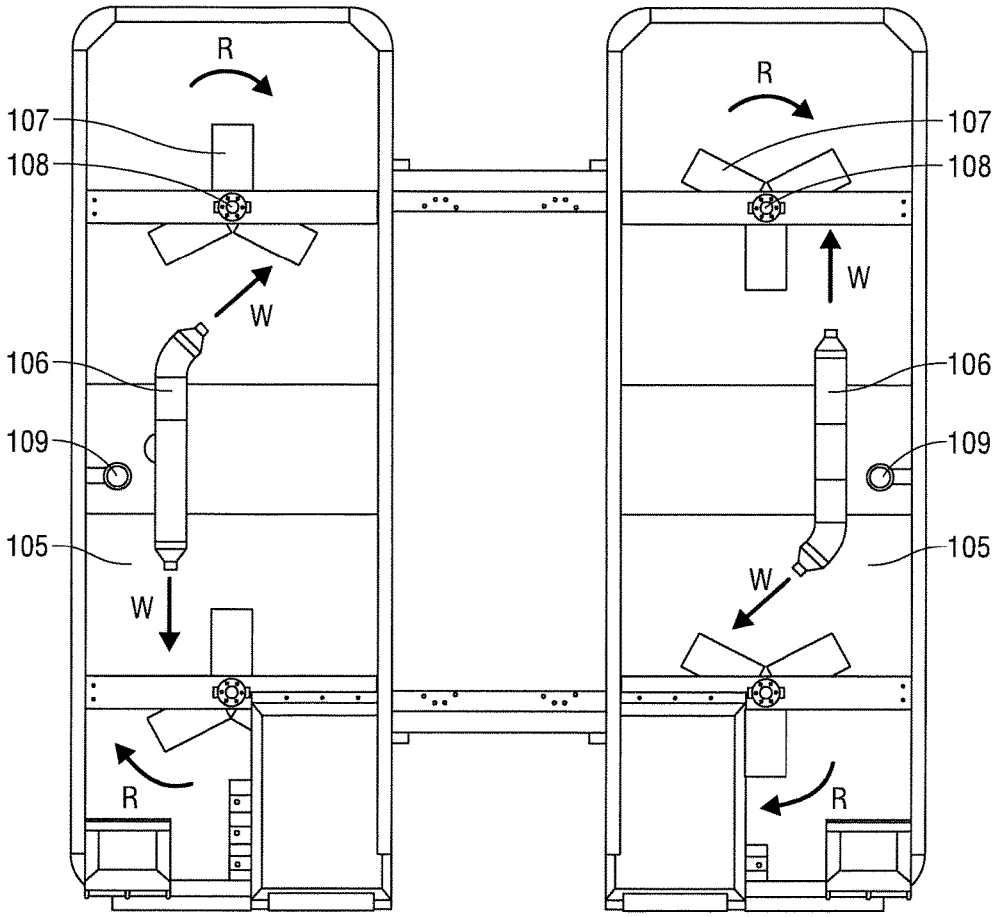
FIG. 5 illustrates a top view of an embodiment of a mixing tank.
Figure 6:
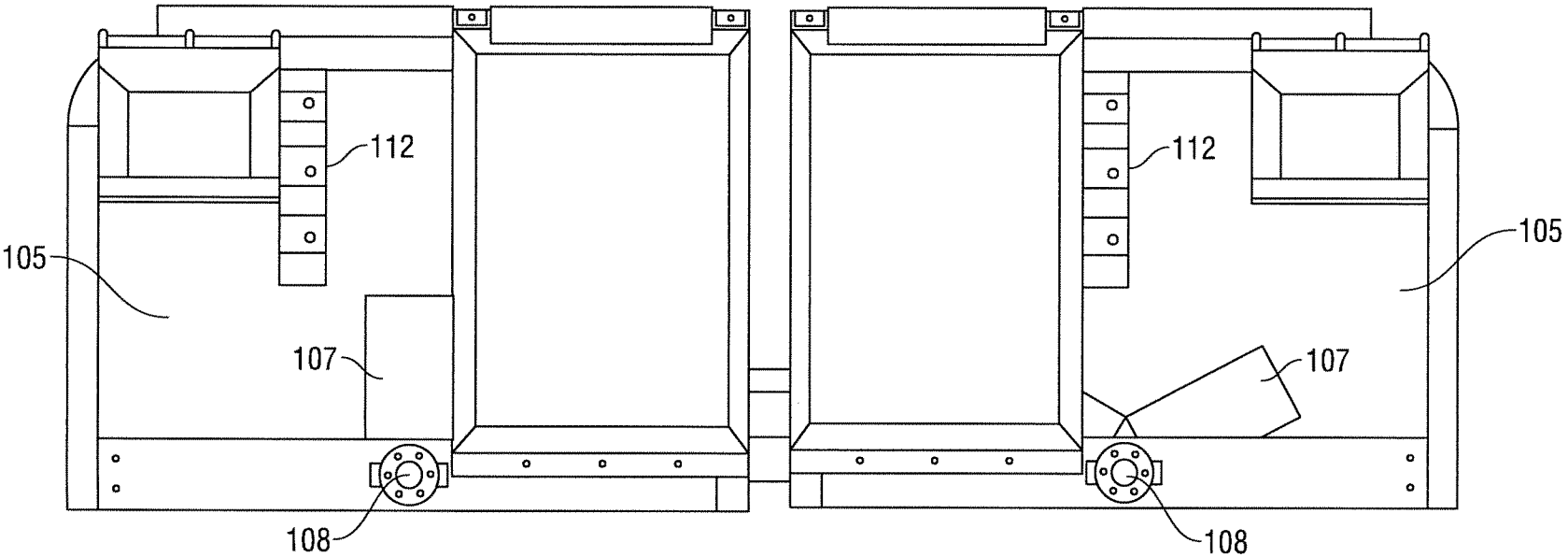
FIG. 6 illustrates a partial top view of an embodiment of a mixing tank.

FIGS. 4-6 illustrate one embodiment of mixing or displacement tanks 105 disposed onboard the chemical mixing and pumping unit 100. The mixing tank 105 is formed having an outer structure capable of holding a fluid within and has an integrated overflow tube 109 near the top in case of overfill. The mixing tank 105 further includes mixing paddles 107 within, which when rotated or oscillated or otherwise moved, agitate fluids within the mixing tank 105. The mixing paddles 107 may be operated or powered by motors 108, such as hydraulic, electric, pneumatic or otherwise. The mixing paddles 107 generally may include at least one flat, bladed oar-type structure attached to a shaft that when rotated or moved causes the structure to contact fluid within the mixing tank 105 and move the fluid about so as to create a shearing action in the fluid. In the embodiment illustrated, the mixing paddles 107 include three (3) substantially equally spaced oar-type structures arranged or spaced about the shaft. Moreover, the oar-type structures of the mixing paddles 107 are angled relative to a horizontal plane. However, as previously explained, any type of oar-type structure arrangement is possible.

The mixing tank 105 includes chemical inlets 112 for delivering chemicals from a separate chemical storage container to the mixing tank 105. As illustrated, the chemical inlets 112 may be located on a top or upper portion or surface of the mixing tank. Chemicals are introduced into the mixing tank 105 through the chemical inlets 112 at the top of the tank and drop directly into the mixing tank 105 during agitation by the mixing paddles, which results in minimal splashing and oxygenation of the mixture.

The mixing tank includes one or more water inlets 106 in a lower portion of the mixing tank 105, or in certain embodiments, at the bottom of the mixing tank 105. Water inlets 106 introduce water into the mixing tank 105. The water inlets 106 direct the water flow—illustrated by representative "W"—towards a nearby mixing paddle 107, and more specifically, towards the oar-type structures of the mixing paddle 107. Moreover, the mixing paddles 107 rotate—illustrated by representative "R"—in a direction opposite the direction of water flow W entering the mixing tank from the water inlet. That is, the mixing oar-type structures of the mixing paddle move toward or approach the stream of water entering the mixing tank. This configuration causes the water stream to strike or impinge on the oar-type structures of the mixing paddle and create a vortex or vortices in the mixture. As a result, agitation of the liquids is greatly increased providing improved mixing and incorporating of liquids within the mixing tank. Advantageously, the mixing tanks are capable of efficient and practical mixing of fluids while reducing the introduction of air/oxygen into the mixture.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A chemical mixing and pumping unit for oilfield operations, the unit comprising:

at least one mixing tank onboard the chemical mixing and pumping unit, the mixing tank comprising:

one or more mixing paddles within the mixing tank;

one or more water inlets located near the bottom of the mixing tank through which water enters the mixing tank and is directed toward the one or more mixing paddles; and one or more chemical inlets through which one or more chemicals enter the mixing tank;

one or more storage tanks capable of storing chemicals onboard the chemical mixing and pumping unit; and one or more pumps corresponding to the individual storage tanks capable of delivering chemicals from the storage tanks to the one or more chemical inlets in the at least one mixing tank.

2. The unit of claim 1, wherein the chemical inlets are located in an upper portion of the mixing tank.

3. The unit of claim 1, wherein the mixing tank is configured having a mixture volume capacity of at least 30 barrels.

4. The unit of claim 1, wherein the one or more pumps are independently controlled to deliver chemicals from the storage tanks at different flow rates to the mixing tank.

5. The unit of claim 1, further comprising a motor associated with and capable of operating each of the one or more mixing paddles.

6. The unit of claim 1, wherein the one or more mixing paddles are configured to rotate in a direction opposite that of the water streams directed towards the mixing paddles.

7. A mixing tank disposed onboard a unit for coiled tubing oilfield operations, the mixing tank comprising:

a mixing paddle within the mixing tank;

a water inlet located near the bottom of the mixing tank through which water enters the mixing tank and is directed toward the mixing paddle; and one or more chemical inlets through which one or more chemicals from chemical storage units enter the mixing tank.

8. The mixing tank of claim 7, further comprising a motor associated with and capable of operating the mixing paddle.

9. The mixing tank of claim 7, wherein the one or more chemical inlets are located at the top of the mixing tank.

10. The mixing tank of claim 7, wherein the mixing paddle is configured to rotate in a direction opposite that of the water stream directed towards the mixing paddle.

11. The mixing tank of claim 7, wherein the mixing paddle includes one or more oar-type structures angled relative to a horizontal plane.

12. A method of mixing liquids in a mixing tank prior to pumping a liquid mixture downhole, the method comprising:

inputting one or more chemicals into the mixing tank through one or more corresponding chemical inlets;

inputting water into the mixing tank through a water inlet at the bottom of the mixing tank and directing the water towards a mixing paddle within the mixing tank; and rotating the mixing paddle in a direction opposite that of the water stream directed towards the mixing paddle, thereby agitating and mixing liquids within the mixing tank.

* * * * *